US005392107A

United States Patent [19]

Paxon et al.

[11] Patent Number: 5,392,107

[45] Date of Patent: Feb. 21, 1995

[54] SHIELD FOR A SHEET TRANSPORT SYSTEM

[75] Inventors: James F. Paxon; George R. Walgrove, III, both of Rochester; Terry N. Morganti, Brockport; Kenneth T. Pociatek, Spencerport, all of N.Y.

[73] Assignee: Eastman Kodak Company, Rochester, N.Y.

[21] Appl. No.: 140,806

[22] Filed: Oct. 21, 1993

Related U.S. Application Data

[63] Continuation-in-part of Ser. No. 984,824, Dec. 3, 1992.

[51] Int. Cl.[6] ..... G03G 15/00

[52] U.S. Cl. ..... 355/312; 355/308; 355/309; 271/197; 271/276

[58] Field of Search ..... 355/308, 309, 312; 271/194, 196, 197, 276

[56] References Cited

U.S. PATENT DOCUMENTS

| | | | |
|---|---|---|---|
| 3,823,937 | 7/1974 | Hirafuji | 271/276 |
| 3,885,785 | 5/1975 | Burkett et al. | 271/197 X |
| 3,940,126 | 2/1976 | Cooper | 271/174 |
| 4,341,455 | 7/1982 | Fedder | 355/274 |
| 4,525,057 | 6/1985 | Kaufmann et al. | 355/309 X |
| 4,618,138 | 10/1986 | Silverberg | 271/197 X |
| 4,831,419 | 5/1989 | Iaia, Jr. et al. | 355/312 X |
| 4,847,652 | 7/1989 | Masuda et al. | 355/274 |
| 4,903,074 | 2/1990 | Lama et al. | 355/312 X |
| 5,016,060 | 5/1991 | Arai | 355/312 |
| 5,031,002 | 7/1991 | Yaguchi | 355/312 |
| 5,063,415 | 11/1991 | Ariyama | 355/312 |
| 5,166,737 | 11/1992 | Tomita | 355/308 |

FOREIGN PATENT DOCUMENTS

| | | | |
|---|---|---|---|
| 0031454 | 2/1985 | Japan | 271/276 |
| 0041357 | 2/1992 | Japan | 271/197 |
| 0041358 | 2/1992 | Japan | 271/197 |
| 0070787 | 3/1992 | Japan | 355/312 |
| 0310973 | 11/1992 | Japan | 359/312 |

*Primary Examiner*—Matthew S. Smith
*Attorney, Agent, or Firm*—Lawrence P. Kessler

[57] ABSTRACT

A vacuum conveyor system for transporting sheets between two process stations in an image producing apparatus, such as copiers and printers. The system includes a plurality of interleaved belts which extend between the process stations and around rollers to convey the sheet without image disruption or sheet damage between the processing stations.

7 Claims, 4 Drawing Sheets

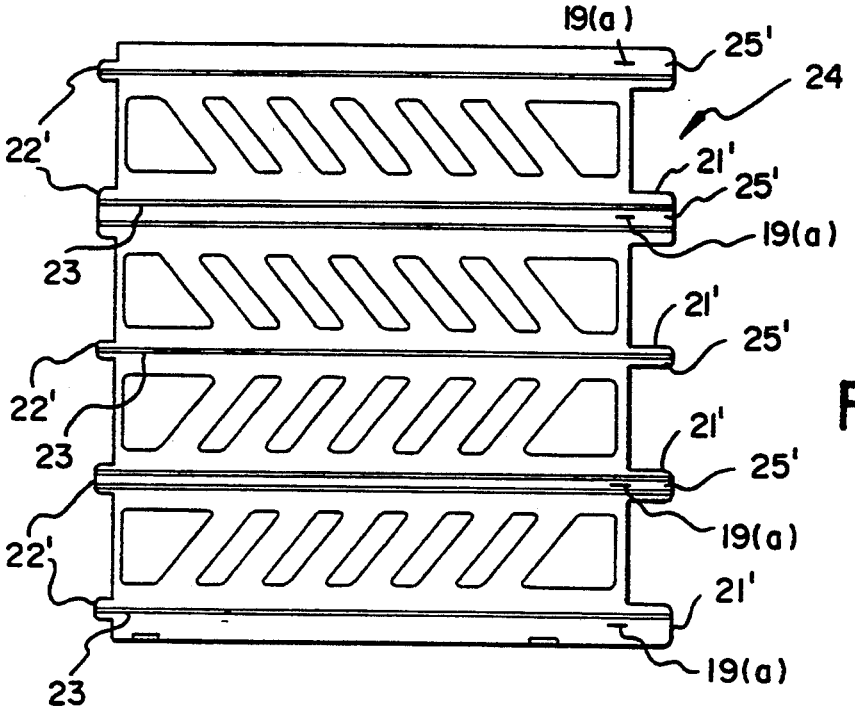
FIG. 3
FIG. 4
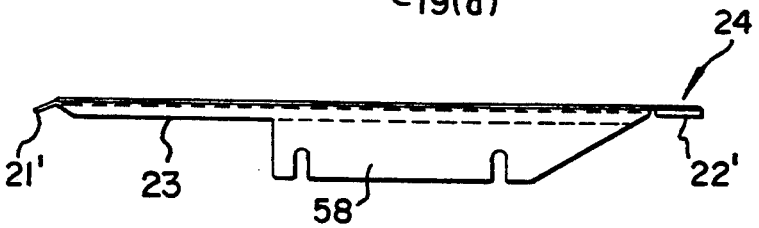
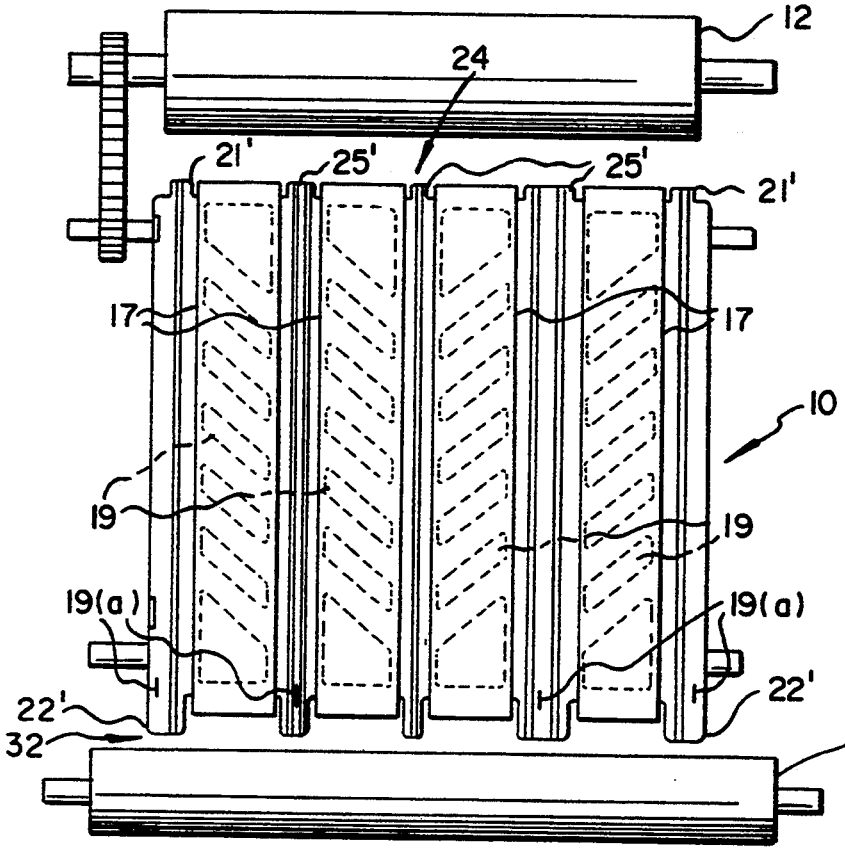
FIG. 5

FIG. 6
PRIOR ART
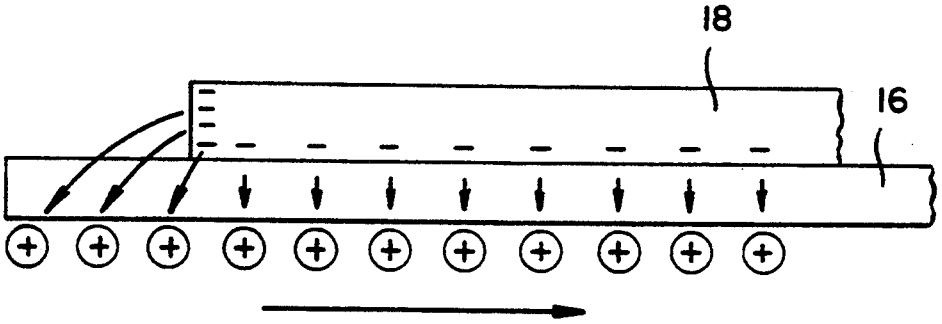
FIG. 7
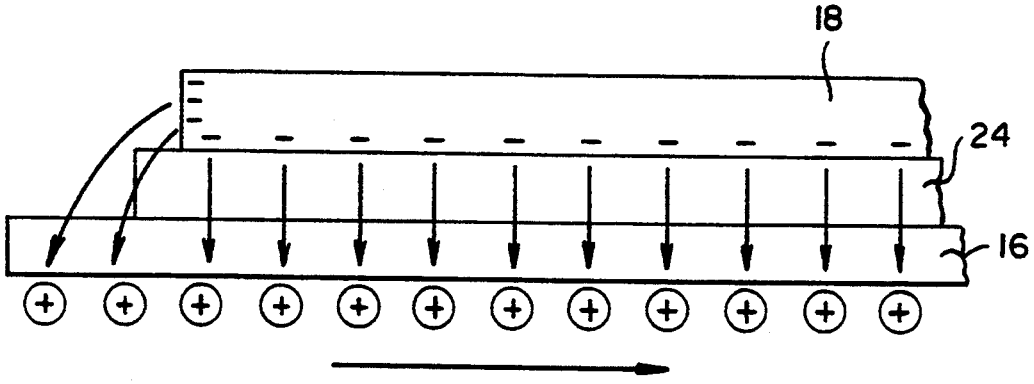
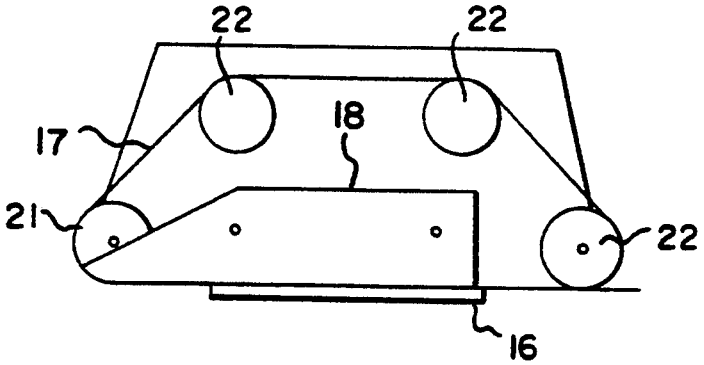
FIG. 8

SHIELD FOR A SHEET TRANSPORT SYSTEM

CROSS-REFERENCE TO RELATED APPLICATION

This is a continuation-in-part application of pending U.S. application Ser. No. 07/984,824, filed Dec. 3, 1992 in the name of James Fuller Paxon et al, entitled SHIELD FOR A SHEET TRANSPORT SYSTEM.

BACKGROUND OF THE INVENTION

1. Field of the Invention

This invention relates, in general, to photocopying apparatus and, more specifically, to prevention of toner image disruption when using a vacuum conveyor system for transporting sheets in copiers and printers.

2. Description of the Prior Art

Image producing apparatus, such as electrostatographic copiers and printers, often have a number of different process stations through which receivers, such as copy sheets, pass for processing. In order to move the sheets between the stations, various types of transport or conveyor systems are used according to conventional practice. One type widely used in the industry employs a vacuum transport system comprised of perforated conveyor belts disposed over openings in a vacuum plenum. There is a differential pressure exerted between the top surface of the sheet, which is exposed to the ambient, and the bottom surface of the sheet adjacent to the perforations of the belts and exposed to the vacuum of the vacuum plenum. This pressure differential causes the sheet to be attracted to and retained by the vacuum through the perforations of the belts, for vacuum belt transport, of the sheet, from one station to another station within the apparatus.

One frequent location for such a vacuum transport system is between the transfer station, where toned images are transferred to the o sheet, and the fixing or fusing station, where the toner, of the toned images, is melted and fused to the sheet to form a permanent image on said sheet. Depending on the application, the conveyor system between these stations either transports the sheet above or below the transport system, but with the image side of the sheet being opposite the belts as the toned sheets are transported to the fusing station for fusing.

While vacuum transport systems are excellent transport systems for conveying sheets from one station to the next, when used to convey toned sheets from a highly charged station such as the transfer station, to an uncharged station, such as the fusing station, disruption of the toned images on said sheets may occur as the sheets leave the transport system. The disruption is caused by an electrical field created by the charge or potential differential between the toner on the transported sheet and the induced charge on the conductive plenum of the vacuum transport system. This differential results from the toner having a charge as it leaves the transfer station, which charge induces an opposite charge on the conductive plenum as the sheet, containing the toned image, moves with the vacuum belts across the conductive plenum. This induced or image charge on the vacuum plenum has a tendency to attract or hinder the toner from moving with its carrier, the transported sheet, as the transported sheet moves toward the fusing station and away from the induced charge. This interaction between the charge of the toner and the charge of the plenum results in a shifting or disruption of the toner particles on the sheet.

One method customarily used to prevent the above attraction or shifting of the toner or toned image caused by such electrical field, is a corona discharge element located adjacent to where the sheet leaves the transport system. By subjecting the charge remaining on the toner to the corona discharge device, the charge on the toner is substantially eliminated. No electrical field, therefore, can be set up between the toner and the plenum that would cause toner disruption. A corona discharge device, however, takes up space in the apparatus, has objectionable ozone discharge, is costly and uses apparatus power.

Another problem with the above transport system is triboelectric charging of the vacuum plenum caused by the transported sheet and vacuum belts rubbing against the plenum, which if not dissipated, causes the surface of the plenum to attract dust and floating toner particles. The dust or toner particles then rub off onto the copy sheet.

In addition to the image disruption problem and the triboelectric problem of vacuum transport systems, such systems also have a tendency to cause wrinkling or creasing of the sheet being transported. The wrinkling is caused by the sheet being drawn into the gaps between the individual vacuum belts of the transport system by vacuum from vacuum ports located in said gaps, which are needed to initially attract and direct the leading edge of the sheet toward the transport system. If this wrinkling or creasing is left uncorrected, the creasing or wrinkling becomes permanent as the sheets pass into and through the fusing station.

Therefore, it is desirable, and an object of this invention, to provide a transport system which can smoothly and predictably control the movement of the sheets, while also controlling the electrical fields established between the sheets and the transport system to avoid any image disruption or wrinkling of the sheets as said sheets are transported between two process stations in a copier, printer, or like apparatus.

SUMMARY OF THE INVENTION

There is disclosed herein a new and useful shielding for a sheet transport system for hard-copy output apparatus, such as copiers and printers.

According to a specific embodiment of the invention, a vacuum receiver transport system is provided for conveying a receiver carrying a toned image from a first process station to a second process station, said system comprising:

a plurality of vacuum belts positioned between the first and second process stations and movable through an endless path to transport the receiver between the first and second process stations;

a vacuum means having a first electrical potential, across which the plurality of belts traverse, for maintaining the receiver, carrying the toned image of a second electrical potential, in contact with the belts; and shielding means located between the vacuum belts and the vacuum means for electrically separating the receiver from the vacuum means while maintaining vacuum between the vacuum means and the receiver.

By using the shield of the transport system of this invention, the sheet is smoothly transported without electrical field disruption of the toned images or wrinkling of the sheet as the sheet is transported from the transfer station to the fusing station by way of a vacuum transport system.

BRIEF DESCRIPTION OF THE DRAWINGS

Further advantages and uses of this invention will become more apparent when considered in view of the following detailed description and drawings, in which:

FIG. 3 is a top view of the shield in accordance with the present invention;

FIG. 4 is a side view of the shield in accordance with the present invention;

FIG. 5 is a top view of the belt and plenum system of FIG. 2 with the shield of the present invention installed;

FIG. 6 is a side view representation of the prior art plenum with a sheet on the plenum illustrating the charge pattern;

FIG. 7 is a side view representation of the plenum and sheet of FIG. 5 with the shield of the present invention in place between the plenum and the sheet;

FIG. 8 is a side view of a typical configuration for the transfer station, photosensitive web, transport system and fuser station; and, FIG. 9 is a side view of a typical image forming apparatus.

DESCRIPTION OF THE PREFERRED EMBODIMENTS

Figure 2:
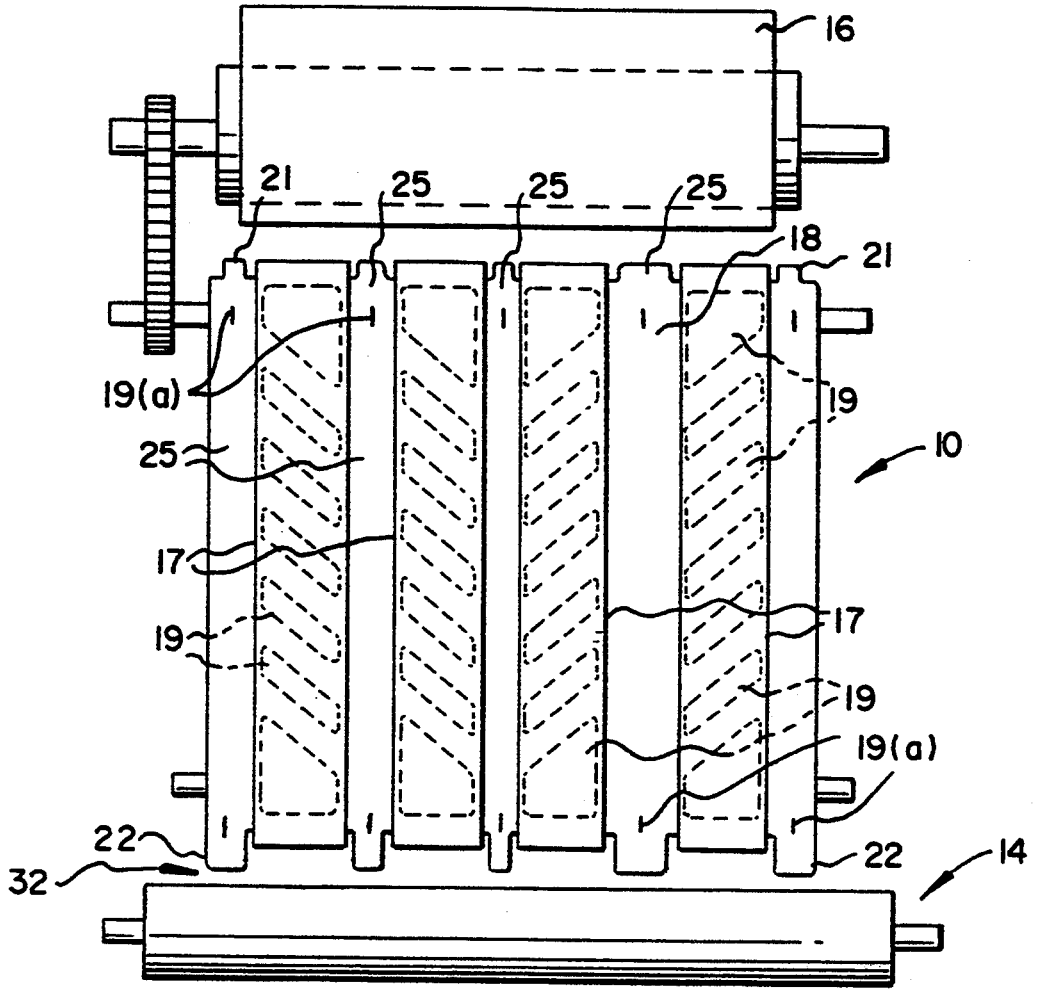
FIG. 2 is a top view of the belt system of FIG. 1 supported by a conductive vacuum plenum upon which the belt system of FIG. 1 rides.

The apparatus of the preferred embodiment will be described in accordance with an electrophotographic recording medium. The invention, however, is not limited to methods and apparatus for creating images on such a medium, as other media may also be used to advantage within the spirit of the invention.

Because electrophotographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, all apparatus will be described in their normal operational position, and terms such as upper, lower, horizontal, etc., will be used with reference to normal operating positions. All apparatus, however, may be manufactured, stored, transported and sold in an orientation other than the normal operational positions described.

All references cited in this specification and their references are incorporated by reference herein where appropriate, for appropriate teaching of additional or alternative details, features and/or technical background.

Throughout the following description, similar reference characters refer to similar elements or members in all of the figures of the drawings.

Figure 1:
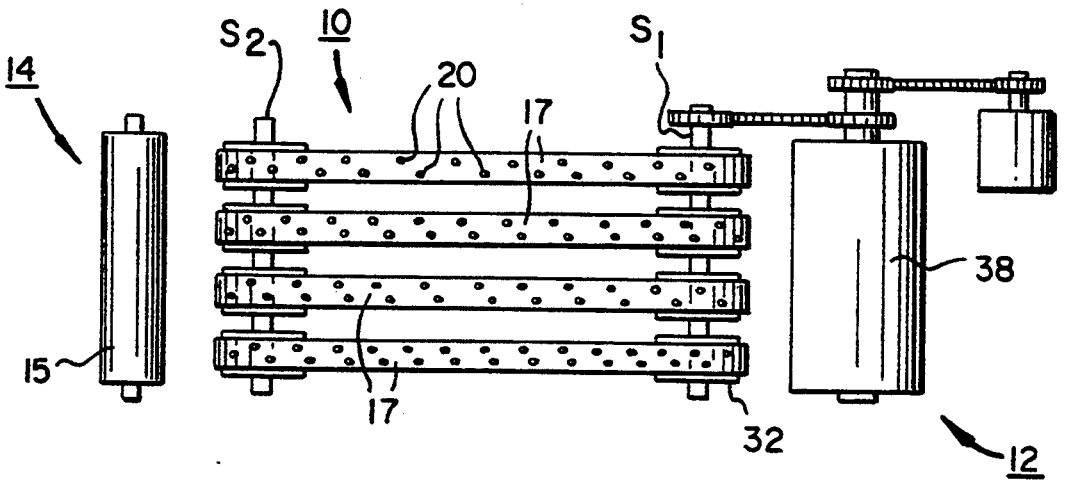
FIG. 1 is a top view of an exemplary belt system of a sheet transport system located between two process stations.

Referring now to the drawings, and to FIG. 1 in particular, there is shown a vacuum belt conveyor system 10 that may be used with the present invention. Conveyor or transport system 10 has belts 17 which are disposed over and around drive sheaves S1 and idler sheaves S2 for driving and directing belts 17 over a vacuum plenum 18 (see FIGS. 8 and 9) that bridges two process stations of a copier. In this embodiment, transport system 10 is positioned between transfer station 12 and fixing or fusing station 14. Transfer station 12 includes a biased transfer roller 38, which rotates in a direction to move a receiver 16, such as a copy sheet, toward transport system 10 while toner on a photosensitive web 30 of an electrophotographic reproduction apparatus is transferred to sheet 16. Sheet 16, with toned images on one surface, is delivered to transport system 10 with its surface, opposite to the surface containing the toned images, in contact with vacuum belts 17, for transport of sheet 16 to fusing station 14. The function of transport system 10 is to convey sheets 16 from one process station to another process station without disruption of the toned image or adverse affect to copy sheet 16.

Figure 9:
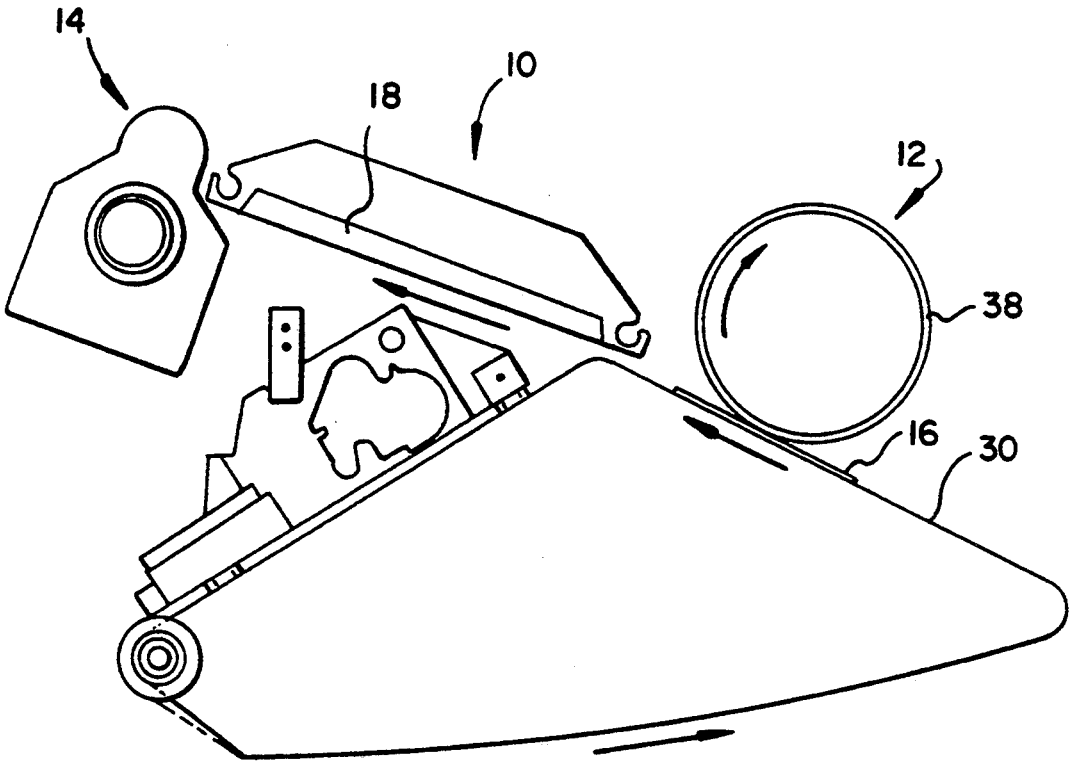

As shown in FIG. 2, vacuum belts 17 ride on an electrically conductive vacuum plenum 18 which has a series of vacuum openings or ports 19 in one wall thereof that allow vacuum from vacuum plenum 18 to be effective through perforations 20 (see FIG. 1) of vacuum belts 17. Plenum 18 also has vacuum ports 19(*a*), between belts 17 for initially attracting and directing the leading edge of sheet 16 to transport system 10 as sheet 16 initially exits transfer station 12. The need for pods 19(*a*) is especially clear, if as shown in FIG. 9, sheet 16 is delivered below transport system 10 where the weight of sheet 16 would cause the force of gravity to move sheet 16 away from transport system 10 if it were not for the effective vacuum force exerted on sheet 16 through vacuum ports 19(*a*). A shield 24 (see FIGS. 3 and 5) is positioned, in the present invention, between belts 17 and plenum 18 and, depending upon application, as to be later explained, said shield is either constructed of an insulating or a semi-conductive material. Shield 24 may be placed upon or replace the top transport support section of vacuum plenum 18 of transport system 10.

Between belts 17 riding on shield 24, are gaps 25' between the respective belts 17. As shown in FIG. 2, ribs 23 having a height equivalent to the thickness of belts 17 are located in gaps 25'. Ribs 23 provide additional support to sheet 16 in the area of gap 25' and thereby prevent sheet 16 from being drawn into such area by the effective vacuum force through vacuum ports 19(*a*) either as sheet 16 is initially drawn toward transport system 10 or as it is continually conveyed across transport system 10. In this manner wrinkles are prevented in sheet 16 during transport over transport system 10 and are not permanently imparted to sheets 16 by the pressure and force of fuser station 14 (typically comprised of a fusing roller 15 and a pressure roller, not shown, but known in the art, which rollers, in cooperation, apply heat and force to the toned image on sheet 16).

As shown by a comparison of FIGS. 2 and 3, shield 24 has the same or substantially the same slots, openings and spacing of plenum 18. While it is not necessary that the slots, openings and spacing be identical, the slots and openings of shield 24 should not interfere with the transfer of vacuum from vacuum plenum 18 to the perforations of belts 17, which vacuum, to said perforations is needed to maintain sheet 16 in contact with belts 17 as sheet 16 is transported across shield 24. As previously stated, shield 24 may be made of either a semi-conductive material, such as an antistat material or of an insulating material, such as Valox, manufactured by General Electric Corporation, depending upon the need to discharge triboelectric build-up on sheet 16 caused by the rubbing or frictional contact of sheet 16 and belts 17 with the surface of shield 24 upon which belts 17 travel. This triboelectric build-up may be controlled in one of two ways. The first is to condition the surface of insulating shield 24, such as by applying a silicone coating, so as to limit the friction of sheet 16 and belts 17 with shield 24 as they move across shield 24 and thereby substantially eliminating any triboelectric build-up. The second is to use a semi-conductive shield 24 so that any triboelectric charge that may build up is slowly discharged, thereby preventing any significant triboelectric build-up that would attract dust and loose toner to shield 24 and cause rub off of the toner or dust to sheet 16. Therefore, if triboelectric build-up can be substantially reduced by the conditioning of the surface of insulating shield 24, in contact with sheet 16, an insulating shield 24 may be used without concern for the small amount of triboelectric build-up. If, however, a substantial build-up of triboelectric charge is caused by movement of sheet 16 and belts 17 over shield 24, a semi-conductive shield 24 may be used to slowly dissipate the triboelectric charge build-up and thereby avoid any adverse effects of the triboelectric charging.

In addition to ribs 23 on shield 24, shield 24 also has tabs 21' and 22' which match or replace tabs 21 and 22 of conductive plenum 18 of transport system 10, see FIGS. 2 and 3. The function of tabs 21' and 22' being the same as the function of tabs 21 and 22, namely tabs 21' are tapered away from belts 17 so that they provide a bridge between transfer station 12 and transport system 10, but due to their tapering will not interfere with the positioning of sheet 16 on transport system 10. Tabs 22' are in the same plane as belts 17 to bridge the transfer of sheet 16 from the transport system 10 to fusing station 14, but due to this positioning of tabs 22', sheets 16 have a tendency to rub against or across tabs 22' and generate a triboelectric charge build-up on tabs 22'. In addition tabs 22' provide point elements for the induced or image charges of plenum 18 to attract the charged unfused toner on sheet 16 and potentially cause image disruption on sheet 16 (see FIG. 6). However, since tabs 21' and 22' are of either a treated insulating material or a non-treated semi-conductive material, the triboelectric charge build-up is either not a factor, if a treated insulator material is used for shield 24, or is dissipated by the use of a semi-conductive shield 24 so as not to be a factor. In addition, since the induced charges on plenum 18 and the charge of the unfused toner on sheet 16 are separated by the thickness of shield 24, this substantially reduces the effect of any image disturbing electrical fields between plenum 18 and the toner on sheet 16 and thereby minimizing toner image disruption on sheet 16 (see FIG. 7).

Shield 24 also has edge members 58, as shown in FIG. 4, which are at right angles to shield 24 for mounting shield 24 to the sides of transport system 10. Edge members 58 make it easy to securely fasten shield 24 to the side of transport system 10 whether or not shield 24 replaces or covers the top surface of plenum 18 of transport system 10.

In operation, as sheets 16, containing charged toned images, leave transfer station 12, sheets 16 are drawn by vacuum effective through ports 19(*a*) toward transport system 10. The vacuum through vacuum ports 19(*a*) cause sheets 16 to make contact with ribs 23, of insulating or semi-conductive shield 24, as well as belts 17 of transport system 10. While ribs 23 only support sheets 16, belts 17 both support and transport sheet 16 in a substantially flat condition across transport system 10 to fuser station 14. Shield 24 maintains sheets 16 far enough removed from conductive vacuum plenum 18 to substantially reduce the image disrupting effect of any electrical fields set up between plenum 18 and the charged toner on sheet 16 such that any significant toner image disruption is eliminated (see FIG. 7). Any triboelectric charging of shield 24 and the dust and toner problem said triboelectric charging causes is rendered insignificant by the use of either a smooth treated surface insulator material or a semi-conductive material for shield 24. Therefore by using the transport system of the invention, sheet 16, carrying unfused toner images, may be conveyed from transfer station 12 to fuser 14 without disruption of the toner images on said sheet or wrinkling of said sheet.

It is emphasized that numerous changes may be made in the above-described system without departing from the teachings of the invention. It is intended that all of the matter contained in the foregoing description, or shown in the accompanying drawings, shall be interpreted as illustrative rather than limiting.

We claim as our invention:

1. A vacuum receiver transport system for conveying a receiver carrying a toned image from a first process station to a second process station, said system comprising:

a plurality of vacuum belts positioned between the first and second process stations and movable through and endless path to transport the receiver between the first and second process stations;

vacuum means across which the plurality of belts traverse for maintaining the receiver in contact with the belts;

shielding means for minimizing image disrupting electrical fields between the toned image carried on the receiver and the vacuum means; and upstanding receiver support ribs, located adjacent to said vacuum belts, on said shielding means to inhibit movement of a receiver into the spaces between the belts for preventing wrinkling of the receiver.

2. The transport system of claim 1 wherein the shielding means is located between the belts and the vacuum means and conforms to at least one surface of the vacuum means.

3. The transport system of claim 1 wherein the shielding means is a friction reducing insulating material for maintaining the toned image on the receiver separated from the vacuum means and for controlling triboelectric build up on the shielding means.

4. The transport system of claim 1 wherein the shielding means is a semi-insulating material for maintaining the receiver separated from the vacuum means and for dissipating triboelectric build-up on the shielding means.

5. A vacuum receiver transport system for conveying a receiver carrying a toned image from a first process station to a second process station, said system comprising:

a plurality of vacuum belts positioned between the first and second process stations and movable through an endless path to transport the receiver between the first and second process stations;

a vacuum means having a first electrical potential, across which the plurality of belts traverse, for maintaining the receiver, carrying the toned image of a second electrical potential, in contact with the belts; and shielding means located between the vacuum belts and the vacuum means for electrically separating the receiver from the vacuum means while maintaining vacuum between the vacuum means and the receiver; said shielding means including upstanding receiver support ribs, located adjacent to said vacuum belts, on said shielding means to inhibit movement of a receiver into the spaces between the belts for preventing wrinkling of the receiver.

6. The transport system of claim 5 wherein the shielding means is a semi-insulating material for maintaining the receiver separated from the vacuum means and for dissipating triboelectric build-up on the shielding means.

7. The transport system of claim 5 wherein the shielding means is a friction reducing insulating material for maintaining the toned image on the receiver separated from the vacuum means and for controlling triboelectric build up on the shielding means.

* * * * *